US009925799B1

(12) United States Patent
Fromm et al.

(10) Patent No.: US 9,925,799 B1
(45) Date of Patent: Mar. 27, 2018

(54) AIR PRESSURE LOADED MEMBRANE AND PIN ARRAY GRIPPER

(71) Applicant: XEROX CORPORATION, Norwalk, CT (US)

(72) Inventors: Paul M Fromm, Rochester, NY (US); Jeffrey J Bradway, Rochester, NY (US); Erwin Ruiz, Rochester, NY (US); Linn C Hoover, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/477,464

(22) Filed: Apr. 3, 2017

(51) Int. Cl.
*B41J 3/407* (2006.01)
*B41J 3/28* (2006.01)
*B41J 2/045* (2006.01)

(52) U.S. Cl.
CPC ..... *B41J 3/4073* (2013.01); *B41J 2/04501* (2013.01); *B41J 3/286* (2013.01)

(58) Field of Classification Search
CPC ..... B41J 2/04501; B41J 3/286; B41J 2/4073
See application file for complete search history.

(56) References Cited

U.S. PATENT DOCUMENTS 6,135,654 A * 10/2000 Jennel ..... B41J 2/01 101/35
8,467,070 B2 * 6/2013 Diefenbacher ..... G01B 11/24 356/601
8,926,047 B2 * 1/2015 LaCaze ..... B41J 2/1752 101/40
9,701,064 B2 * 7/2017 Donaldson ..... B29C 67/0059

OTHER PUBLICATIONS

U.S. Appl. No. 15/163,880, filed May 25, 2016, and entitled System for Printing on Three-Dimensional (3D) Objects by Wayne A. Buchar et al.

* cited by examiner

*Primary Examiner* — Anh T. N. Vo

(57) ABSTRACT

A universal gripper of objects includes two elastomer membranes separating a bed of rounded tipped nails that allow for object conformation. The object is pushed into a membrane that contacts the object with a known air pressure behind an inner membrane inside the gripper. The air pressure provides conformance and maximum resolution of object curvature to the bed of nails. At least one pin guide and locking plate having flexure fingers is actuated causing a small displacement which clamps each nail in its deformed position. The air pressure on the inner membrane is now removed and afterwards, a vacuum blower is turned ON causing the object to be gripped for removal from a staging platen and moved to a position to receive an image from a printer.

20 Claims, 4 Drawing Sheets

AIR PRESSURE LOADED MEMBRANE AND PIN ARRAY GRIPPER

CROSS REFERENCE TO RELATED APPLICATIONS

Cross-referenced is commonly assigned U.S. application Ser. No. 15/477,125, Filed Apr. 3, 2017, and entitled VACUUM TUBE OBJECT CLAMPING ARRAY WITH CONFORMABLE PADS; U.S. application Ser. No. 15/477,127, filed Apr. 3, 2017, and entitled APPARATUS FOR HOLDING DURING THREE-DIMENSIONAL (3D) OBJECTS DURING PRINTING THEREON; U.S. application Ser. No. 15/477,126, filed Apr. 3, 2017, and entitled UNIVERSAL PART GRIPPER WITH CONFORMABLE TUBE GRIPPERS; U.S. application Ser. No. 15/477,427, filed Apr. 3, 2017, and entitled SPRING LOADED SUCTION CUP ARRAY GRIPPER; U.S. Application Ser. No. 62/480,563, filed Apr. 3, 2017, and entitled UNIVERSAL OBJECT HOLDER FOR 3-D PRINTING USING A CONFORMABLE GRIPPER BALL; U.S. application Ser. No. 15/477,439, filed Apr. 3, 2017, and entitled UNIVERSAL PART GRIPPER USING 3-D PRINTED MOUNTING PLATE; U.S. application Ser. No. 15/477,454, filed Apr. 3, 2017, and entitled APPARATUS FOR GENERAL OBJECT HOLDING DURING PRINTING USING MULTIPLE CONFORMABLE BALLS; U.S. application Ser. No. 15/477,488, filed Apr. 3, 2017, and entitled APPARATUS FOR REPEATABLE STAGING AND HOLDING OBJECTS IN A DIRECT TO OBJECT PRINTER USING AN ARRAY OF PINS; and U.S. application Ser. No. 15/477,478, filed Apr. 3, 2017, and entitled SPRING LOADED IRIS MECHANISM STACK GRIPPER by Paul M. Fromm et al; all of which are included in their entirety herein by reference.

TECHNICAL FIELD

This disclosure relates generally to a system for printing on three-dimensional (3-D) objects, and more particularly, to an apparatus adapted for general object holding in a non-production environment.

BACKGROUND

Commercial article printing typically occurs during the production of the article. For example, ball skins are printed with patterns or logos prior to the ball being completed and inflated. Consequently, a non-production establishment, such as a distribution site, which customizes products, for example, in region in which potential product customers support multiple professional or collegiate teams, needs to keep an inventory of products bearing the logos of the various teams. Ordering the correct number of products for each different logo to maintain the inventory can be problematic.

One way to address these issues in non-production outlets would be to keep unprinted versions of the products, and print the patterns or logos on them at the distribution site. Adapting known printing techniques, such as two-dimensional (2-D) media printing technology, to apply image content onto 3-D objects would be difficult. Since the surfaces to be printed must be presented to the print heads as relatively flat, 2-D surfaces, the objects have to be maneuvered carefully to present portions of the articles as parallel planes to the print heads.

One Direct to Object printing system that accomplishes this is disclosed in copending and commonly assigned U.S. patent application Ser. No. 15/163,880, filed on May 25, 2016, and entitled SYSTEM FOR PRINTING ON THREE-DIMENSIONAL (3D) OBJECTS by Wayne A. Buchar et al. This printing system includes a plurality of print heads arranged in a 2-D array, each printhead being configured to eject marking material, a support member positioned to be parallel to a plane formed by the 2-D array of print heads, a member movably mounted to the support member, an actuator operatively connected to the movably mounted member to enable the actuator to move the moveably mounted member along the support member, an object holder configured to mount to the movably mounted member to enable the object holder to pass the array of print heads as the moveably mounted member moves along the support member, and a controller operatively connected to the plurality of print heads and the actuator, the controller being configured to operate the actuator to move the object holder past the array of print heads and to operate the plurality of print heads to eject marking material onto objects held by the object holder as the object holder passes the array of print heads. This application is included herein by reference to the extent necessary to the practice the present disclosure and in its entirety.

A problem with this approach is that it requires a unique part holder for each part that is to be printed. The part holders are currently machined metal brackets with dedicated locating and fastening features machined into each holder. Unique holders are made for each part that is printed on.

SUMMARY

In answer to this shortcoming, disclosed is a universal holder for many types of objects. The universal holder includes two latex or similar elastomer membranes separating a bed of rounded tipped nails that allow for object conformation. The object is pushed into a membrane that contacts the object with a known air pressure behind an inner membrane inside the holder. The air pressure provides conformance and maximum resolution of object curvature to the bed of nails. The pins slide through holes in at least one pin guide plate. At least one locking plate having flexure fingers by each pin is actuated causing a small displacement, which clamps each nail in its deformed position. The internal pressure is removed. Afterwards, a vacuum blower is turned ON to hold the object in place.

BRIEF DESCRIPTION OF THE DRAWINGS

The foregoing aspects and other features of a printing system that prints images on 3-D objects are explained in the following description, taken in connection with the accompanying drawings.

DETAILED DESCRIPTION

Figure 1:
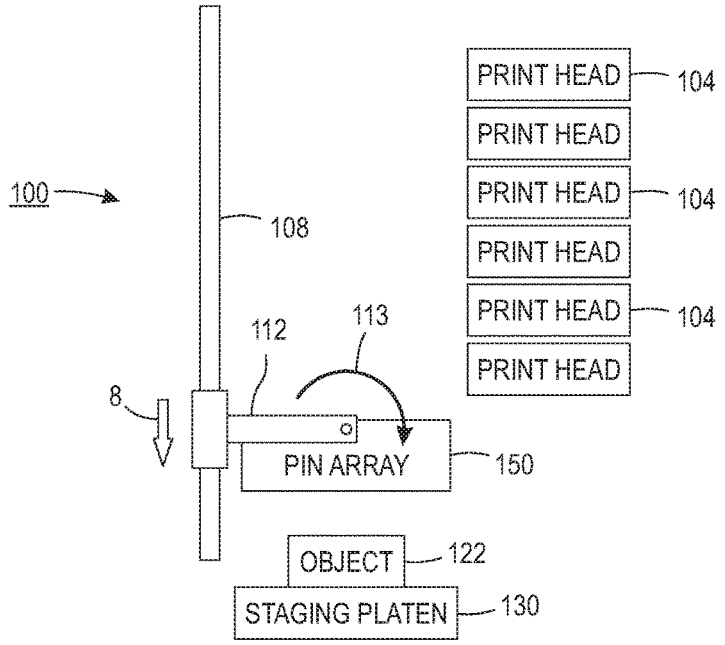
FIG. 1 illustrates an exemplary partial block printing system 100 configured to print on a 3-D object held by a universal object holder that includes a membrane-pin array in an object capturing position.

For a general understanding of the present embodiments, reference is made to the drawings. In the drawings, like reference numerals have been used throughout to designate like elements.

FIG. 1 illustrates an exemplary printing system 100 configured to print on a 3D object. The printing system 100 includes an array of print heads 104, a support member 108, a member 112 movably mounted to the support member 108 to be moved in the direction of arrow 8 in FIG. 1 and arrow 9 in FIG. 2 and a universal object holder 150 configured to pivotally mount to the movably mounted member 112 and adapted to rotate in the direction of arrow 113 to pick up an object. As shown in FIG. 1, the array of print heads 104 is arranged in a two-dimensional array, which in the figure is a 10×1 array, although other array configurations can be used. Each print head is fluidly connected to a supply of marking material (not shown) and is configured to eject marking material received from the supply. Some of the print heads can be connected to the same supply or each print head can be connected to its own supply so each print head can eject a different marking material.

The support member 108 is positioned to be parallel to a plane formed by the array of print heads and, as shown in the figure, is oriented so one end of the support member 108 is at a higher gravitational potential than the other end of the support member. This orientation enables the printing system 100 to have a smaller footprint than an alternative embodiment that horizontally orients the array of print heads and configures the support member, movably mounted member, and object holder to enable the object holder to pass objects past the horizontally arranged print heads so the print heads can eject marking material downwardly on the objects.

Figure 2:
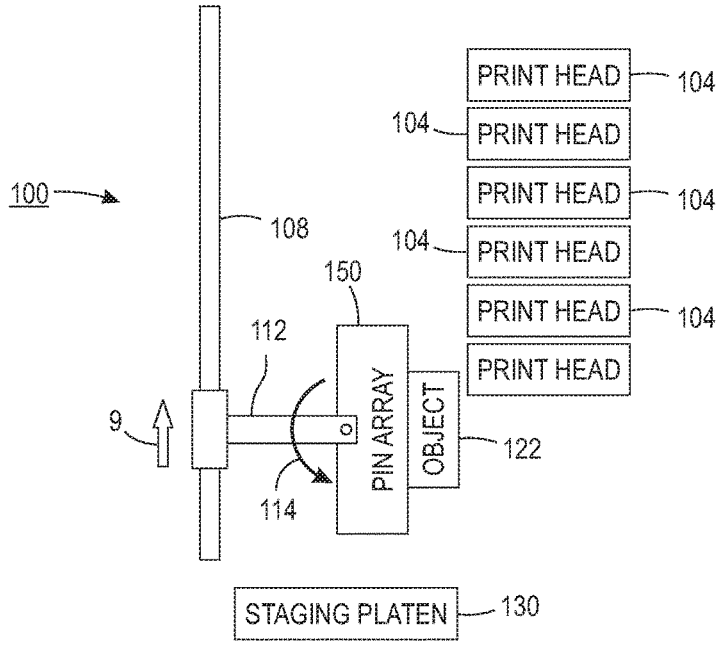
FIG. 2 illustrates the exemplary partial block printing system 100 in FIG. 1 with the universal object holder in position to receive printing.

The member 112 is movably mounted to the support member 108 to enable the member to slide bi-directionally along the support member. In FIG. 1, the universal object holder 150 has been rotated by member 112 through conventional means into a first position or object acquiring positioned that is parallel to staging platen 130. Object 122 has been positioned onto staging platen 130 for acquisition. In FIG. 2, object 122 has been acquired and universal object holder 150 has been rotated in the direction of arrow 114 into a second position and member 112 now moves object 122 along the length dimension of the array of print heads 104 by conventional means, such as, with the use of pulleys and belts or a screw drive.

The system configuration shown in FIG. 1 is especially advantageous in a number of aspects. For one, as noted above, the vertical configuration of the array of print heads 104 and the support member 108 enables the system 100 to have a smaller footprint than a system configured with a horizontal orientation of the array and support member. This smaller footprint of the system enables the system 100 to be housed in a single cabinet and installed in non-production outlets. Once installed, a universal or general object holder, as described further below, can be used with the system to print a variety of goods that are generic in appearance until printed.

Figure 3:
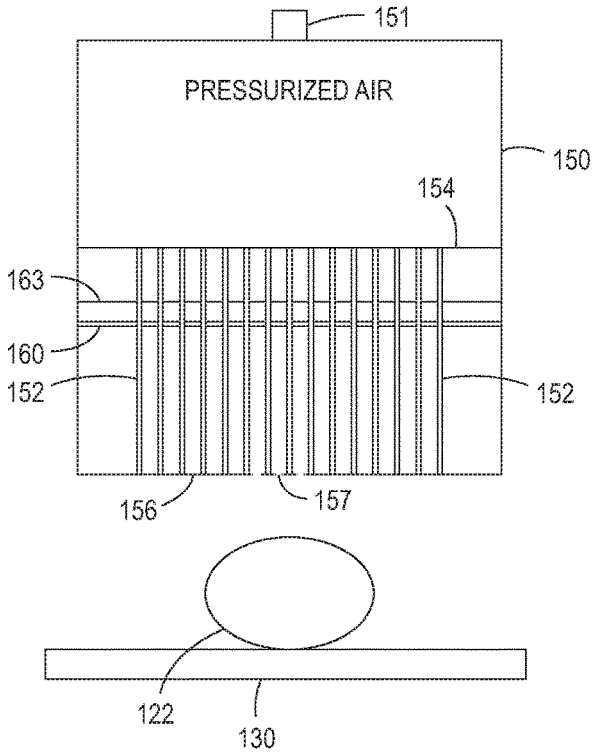
FIG. 3 shows a side view of the universal object holder of FIG. 1 before contacting an object.

Turning now to the present disclosure, a generic or universal object holder 150 is shown in FIG. 3 in a non-contacting position with respect to object 122 and includes a biasing elastomer membrane 154 positioned above and backing a bed of rounded nails or pins 152 that are free to move along their long axis through the pin guide plate 163 and conform to the shape of object 122. Pins 152 slide through a pin guide plate 163 and locking plate 160 and are biased by elastomer membrane 154 towards an object membrane 156 due to pressurized air from air pressure device 151. A lubricant between object membrane 156 and biasing elastomer membrane 154 and rounded nails or pins 152 serves to allow object membrane 156 and biasing elastomer membrane 154 to stretch without puncturing and bending the pins. One row of pins is shown but this is a 2-D array. The magnitude of air pressure is operator adjustable and change the force pins 152 exert on object membrane 156 and ultimately object 122. For example, a low pressure would be for low stiffness or low curvature objects and high pressure for stiff, tall or high curvature objects. Staging platen 130 uses gravity and movable datum to repeatably locate subsequently loaded objects.

A method for keeping the biasing elastomer membrane 154 and object membrane 156 substantially flat when the assembly in not in contact with an object includes providing a ring on each pin 152 that will contact the pin guide plate stopping the pin 152 relative to the guide plate 163 as the biasing elastomer membrane 154 pushed them down. Another method is to add a second pin guide plate nearly in contact with the un-deformed inside of the biasing elastomer membrane 154. Or move the single pin guide plate 163 and the biasing elastomer membrane 154 close to each other.

Figure 4:
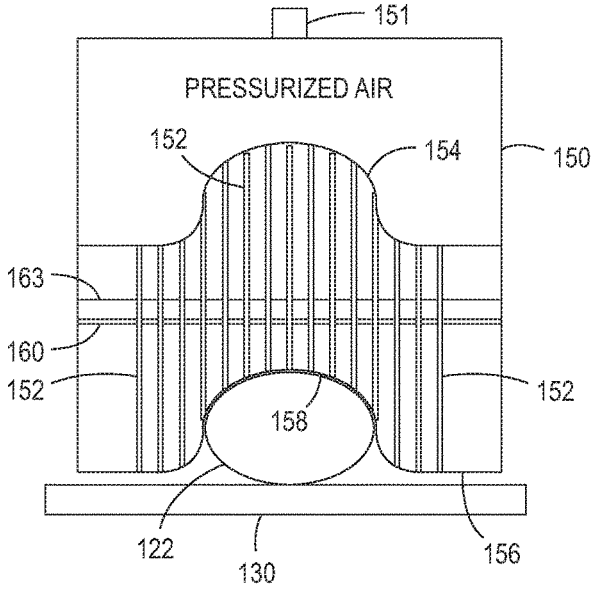
FIG. 4 depicts side view details of the universal object holder shown in FIG. 3 after having contacted an object.

In FIG. 4, moveable member 112 has moved down support member 108 and pressurized air at 151 through elastomer membrane 154 has pressed pins 152 to deform object membrane 156 into the curvature of object 122. The radius of curvature and degree of conformance of object membrane 156 to object 122 will depend on the stiffness of the membrane and air pressure.

Figure 6:
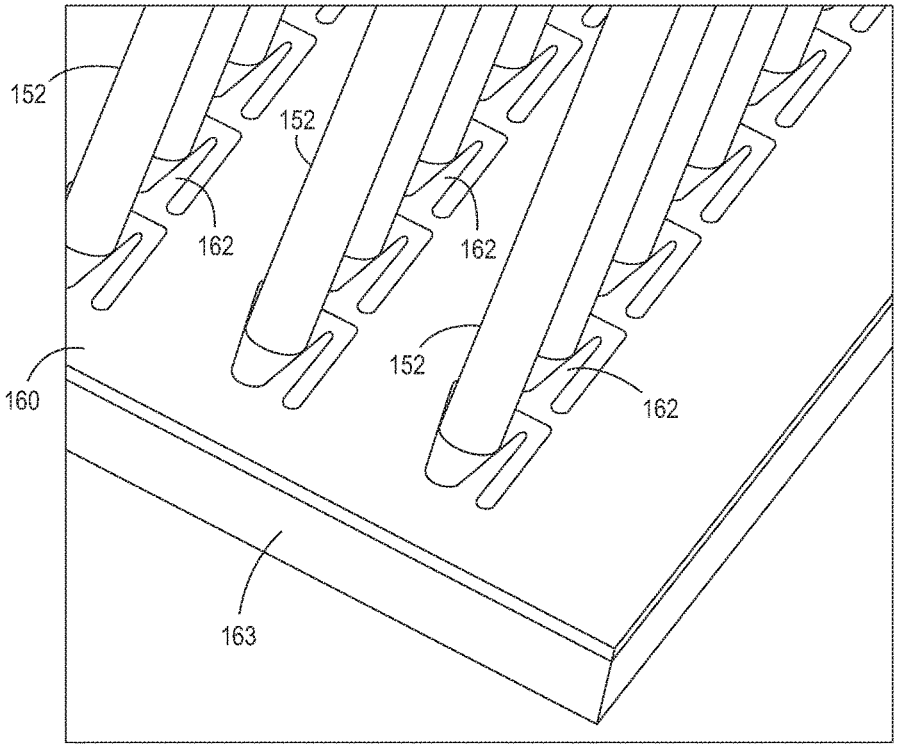
FIG. 6 shows a locking plate after a pin array has conformed to the object.

Locking plate 160 in FIG. 6 rigidizes pin array 152 after the pins and membranes 154 and 156 have conformed to object 122. Each compliant finger 162 contacts pin 152 when locking plate 160 is moved a small distance after pins 152 are pushed into the curvature of object 122. Compliant fingers 162 thus lock the position of all pins relative to locking plate 160 and pin guide plate 163. The compliant fingers 162 allow a single locking plate to lock all pins while using relatively loose manufacturing tolerances to fabricate the pins 152, pin guide plate 163 and locking plate 160.

Figure 5:
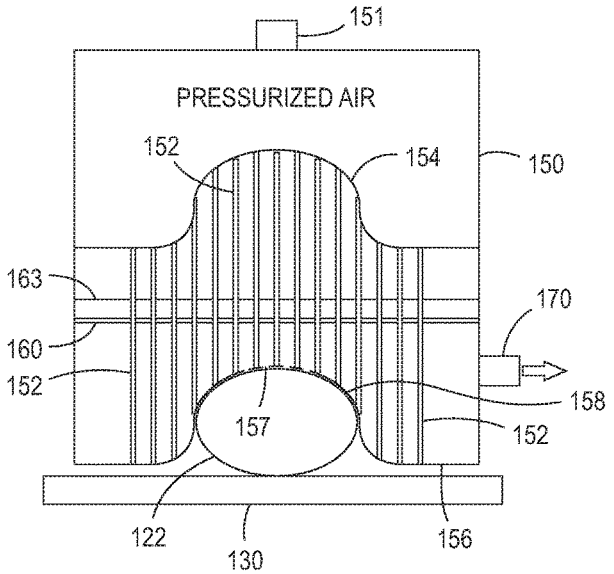
FIG. 5 is a side view the universal object holder in FIG. 4 showing vacuum being applied thereto.

Once the pins 152 are locked to the pin guide plate 163 the air pressure 151 above biasing elastomer membrane 154 may then be reduced to zero or left unchanged. Reducing the air pressure reduces the force the pin locks need to resist to keep the pins from moving. A predetermined vacuum flow from vacuum source 170 in FIG. 5 is applied to object holder 150 to reduce pressure between biasing elastomer membrane 154 and object membrane 156. A minimal number of holes 157 are placed into the center of object membrane 156 to apply vacuum to object 122. A layer of textile felt 158 that is air permeable even when compressed to 14 psi can be laid on top of objects placed on staging platen 130 to increase the surface area that experiences vacuum, however, the textile felt 158 would need to be smaller than the object. The object is now rigidly held by the object holder 150 and is ready to be lifted off the staging and alignment platen 130.

Figure 7:
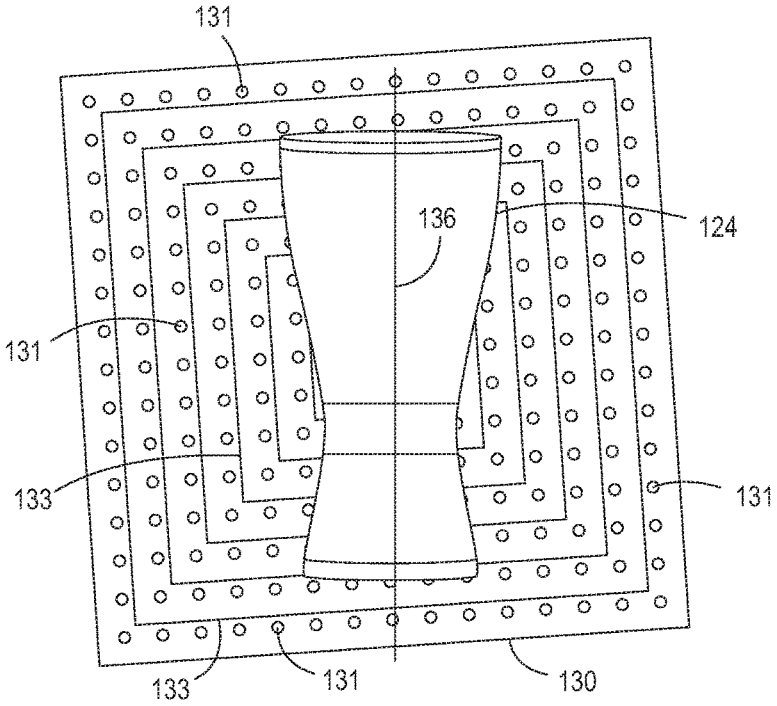
FIG. 7 depicts a plan view of a staging and alignment platen of FIG. 1.
Figure 8:
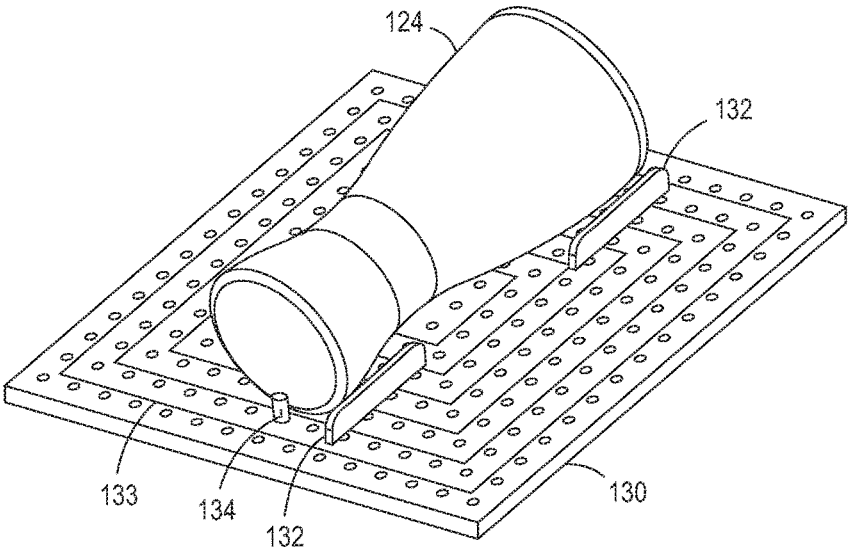
FIG. 8 depicts an isometric view of the staging and alignment platen of FIG. 7.

Staging and alignment platen 130 in FIGS. 7 and 8 includes holes 131 for pegs 134 and walls 132 and concentric markings 133 to aid an operator in centering object 124. Walls 132 and Pegs 134 are short and ideally in the shadow of the top view of the object. If an object axis 136 is skewed relative to the platen as shown in FIG. 7, a vison system can be used to make a digital image of the object and determine where it is relative to the machine datum, then the data containing the image to be printed can then be rotated and translated to match the object orientation, within the limitations of the width of the print heads. Alternatively, platen 130 can be rotated and translated to center the object into the print zone using the digital image information from the vision system and mechanical drivers under numerical control. Without a vision system, platen 130 can be manually rotated and translated to center object 124 under cross hairs of light projected from above object 124 with conventional devices and operator eyes and hands doing the control. Moving staging and alignment platen 130 into alignment with print heads 104 and process direction maximizes the printable area of object 124. Compliant guides containing spring-loaded plungers or compliant foam faces can be placed against the object to prevent round objects from rolling away from walls 132 or pegs 134.

In recapitulation, holding a variety of 3-D part sizes for printing thereon is accomplished with a generic holder that includes a pickup head having an array of pins loaded by a pair of elastomer membranes mounted to a movable carriage that moves parts past print heads of a device that prints on the parts. The array of pins is pivotally attached to the carriage so it can face downward or horizontally for part loading and vertically for printing. A staging platen is provided that uses gravity and movable datum to ensure repeatability of parts placement. The two elastomer membranes separate a bed of rounded tipped nails or pins that allow the gripper assembly to conform to the shape of the 3-D part. The part is pushed into the part side elastomer membrane with a known pressure behind the inner elastomer membrane inside the pickup head. Both elastomer membranes includes a lubricant on the side thereof facing the heads of the array of pins to allow stretching without puncturing and bending the pins. The pressure provides conformance and maximum resolution of part curvature to the array of pins. The pressure can be varied to ensure proper compliance without crushing the part. One or two locking plates depending on the density of the pins with flexure fingers are actuated either in x or y directions causing a small displacement which clamps each pin in a new deformed position. The internal pressure may be removed to reduce the load that the pin locks need to provide to keep the pins from moving. A vacuum blower is then turned ON to hold the part in place against the part membrane. Holes are located in the middle of the area of which there is less pin density to allow for elastomer spread without the pins falling through the stretched holes. The vacuum is applied through a felt interface that touches the part and spreads the vacuum area to provide greater lifting force if needed. The felt is smaller than the object so the membrane seals to the object to prevent losing vacuum. The movably mounted member or carriage is moved upward lifting the part. The pin array and part is then rotated to the printing position. After printing the part is set back onto the staging platen and released from the pickup head which then moves up to allow part unload and reload.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An object holder for a printing system, comprising:

a pickup head configured to grip an object at a first location, move said object to a second location and return said object to said first location;

wherein said pickup head includes a first chamber separated from a second chamber by an elastomer biasing membrane with said second chamber being enclosed by an object membrane having minimal holes in a central portion thereof for vacuum access, said first chamber including an air pressure source and said second chamber including a vacuum source; and wherein said second chamber includes a pin array positioned between said elastomer biasing membrane and said object membrane.

2. The object holder of claim 1, including an apparatus for pushing said pickup head downward to make contact with an object, and wherein air pressure is applied to said first chamber to assist in pushing said elastomer biasing membrane into said pin array and said pin array into said object membrane with said object membrane conforming in radius of curvature to said object.

3. The object holder of claim 2, including a felt material adapted to be positioned on top of an object to increase the surface area that experiences vacuum pressure.

4. The object holder of claim 3, wherein second chamber includes a locking plate through which pins of said pin array extend while contacting said elastomer biasing membrane and object membrane.

5. The object holder of claim 4, wherein said locking plate includes compliant fingers used to stabilize said pin array as they move within said second chamber.

6. The object holder of claim 1, wherein said pickup head is adapted to be pivoted between horizontal and vertical positions.

7. The object holder of claim 1, wherein said object holder is incorporated into a printer that prints on 3-D objects.

8. The object holder of claim 7, including a support member and wherein said object holder is supported by said support member and adapted for vertical movement adjacent print heads of said printer.

9. The object holder of claim 1, including a vacuum source connected to said second chamber to apply vacuum to said second chamber and thereby cause said object membrane to grip said object.

10. The object holder of claim 9, wherein said air pressure source is cut off before said vacuum source is activated.

11. The object holder of claim 2, including a lubricant between said elastomer biasing membrane and said object membrane and heads of pins in said pin array to allow said elastomer biasing membrane and said object membrane to stretch without said pins puncturing said elastomer membranes or bending.

12. The object holder of claim 11, including a staging and alignment platen onto which said object is placed, and wherein said staging and alignment platen is adapted for rotation and translation to match object orientation.

13. An universal gripper for gripping and holding objects, comprising:

a support member;

a member mounted to said support member for vertical movement; and a pickup head mounted to said member and configured for rotary movement from a first position parallel to an object staging platen before gripping an object into a second position orthogonal to said first position after an object has been gripped, said pickup head including a pressure chamber adapted to receive pressurized air and a vacuum chamber with a vacuum source attached thereto, said pressure chamber being separated from said vacuum chamber by an elastomer membrane, said vacuum chamber including a pin array with an upper end of said pin array contacting a bottom surface of said elastomer membrane and a lower end of said pin array contacting an object membrane, and a locking plate for securing said array of pins once they have moved.

14. The universal gripper of claim 13, including an air pressure source connected to said pressure chamber and a vacuum source connected to said vacuum chamber.

15. The universal gripper of claim 14, wherein movement of said member pushes said pin array that in turn deforms said object membrane into the shape of an object.

16. The universal gripper of claim 15, wherein said locking plate includes compliant fingers that stabilize said pin array when contact with an object causes said a number of pins of said pin array to be pushed into said elastomer membrane.

17. The universal gripper of claim 16, including an air permeable felt material added to a top surface of said object in order to spread the vacuum area without losing vacuum.

18. The universal gripper of claim 17, including holes in a central portion of said object membrane where the density of pins is less to allow said object membrane to spread without said pins of said pin array falling through said holes in said object membrane.

19. The universal gripper of claim 18, including a staging and alignment platen, said staging and alignment platen including holes therein for the insertion of pegs and walls to stabilize an object thereon.

20. The universal gripper of claim 13, wherein said universal gripper is incorporated into a printer that prints on 3-D objects.

* * * * *